US011030936B2

(12) United States Patent
Emelie et al.

(10) Patent No.: US 11,030,936 B2
(45) Date of Patent: Jun. 8, 2021

(54) METHODS AND APPARATUS FOR OPERATING AN ELECTRO-OPTIC DISPLAY IN WHITE MODE

(71) Applicant: E Ink Corporation, Billerica, MA (US)

(72) Inventors: Pierre-Yves Emelie, Arlington, MA (US); Kenneth R. Crounse, Somerville, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 15/427,202

(22) Filed: Feb. 8, 2017

(65) Prior Publication Data

US 2017/0148372 A1 May 25, 2017

Related U.S. Application Data

(63) Continuation-in-part of application No. 13/755,111, filed on Jan. 31, 2013.

(Continued)

(51) Int. Cl.
*G09G 3/20* (2006.01)
*G09G 3/34* (2006.01)

(52) U.S. Cl.
CPC ..... *G09G 3/2044* (2013.01); *G09G 3/344* (2013.01); *G09G 2310/06* (2013.01);
(Continued)

(58) Field of Classification Search
CPC ..... G09G 3/2044; G09G 3/344; G09G 2310/062; G09G 2310/06;
(Continued)

(56) References Cited

U.S. PATENT DOCUMENTS 4,418,346 A 11/1983 Batchelder
5,760,761 A 6/1998 Sheridon
(Continued)

FOREIGN PATENT DOCUMENTS

CN 103247268 A 8/2013
JP 2009053436 A 3/2009
(Continued)

OTHER PUBLICATIONS

European Patent Office; EP17020064.6; Extended European Search Report; dated Aug. 21, 2017. Aug 21, 2017.
(Continued)

*Primary Examiner* — Brent D Castiaux
(74) *Attorney, Agent, or Firm* — Zhen Bao

(57) ABSTRACT

Techniques for operating an electro-optic display to reduce the appearance of light edge artifacts in displayed images are described. A method for operating the electro-optic display includes detecting a null state transition of a first pixel when transitioning from a first image to a second image. The method further includes determining whether a threshold number of cardinal neighbors of the first pixel transition from a black state to a white state when transitioning from the first image to the second image. In response to a subsequent transition to a third image, the method further includes applying a voltage signal to the first pixel, wherein the voltage signal has a waveform configured to generate an optical black state for the first pixel.

8 Claims, 17 Drawing Sheets

Related U.S. Application Data

(60) Provisional application No. 62/292,829, filed on Feb. 8, 2016, provisional application No. 61/593,361, filed on Feb. 1, 2012.

(52) U.S. Cl.
CPC . *G09G 2310/062* (2013.01); *G09G 2310/063* (2013.01); *G09G 2310/068* (2013.01); *G09G 2320/0204* (2013.01); *G09G 2320/0209* (2013.01); *G09G 2320/0257* (2013.01)

(58) Field of Classification Search
CPC ..... G09G 2310/068; G09G 2310/063; G09G 2320/0257; G09G 2320/0209; G09G 2320/0204
See application file for complete search history.

(56) References Cited

U.S. PATENT DOCUMENTS 5,777,782 A 7/1998 Sheridon
5,808,783 A 9/1998 Crowley
5,872,552 A 2/1999 Gordon, II et al.
5,930,026 A 7/1999 Jacobson et al.
6,054,071 A 4/2000 Mikkelsen, Jr.
6,055,091 A 4/2000 Sheridon et al.
6,097,531 A 8/2000 Sheridon
6,128,124 A 10/2000 Silverman
6,130,774 A 10/2000 Albert et al.
6,137,467 A 10/2000 Sheridon et al.
6,144,361 A 11/2000 Gordon, II et al.
6,147,791 A 11/2000 Sheridon
6,172,798 B1 1/2001 Albert et al.
6,184,856 B1 2/2001 Gordon, II et al.
6,225,971 B1 5/2001 Gordon, II et al.
6,241,921 B1 6/2001 Jacobson et al.
6,271,823 B1 8/2001 Gordon, II et al.
6,301,038 B1 10/2001 Fitzmaurice et al.
6,445,489 B1 9/2002 Jacobson et al.
6,504,524 B1 1/2003 Gates et al.
6,512,354 B2 1/2003 Jacobson et al.
6,531,997 B1 3/2003 Gates et al.
6,650,462 B2 11/2003 Katase
6,672,921 B1 1/2004 Liang et al.
6,731,261 B2 5/2004 Schlangen et al.
6,753,999 B2 6/2004 Zehner et al.
6,788,449 B2 9/2004 Liang et al.
6,816,138 B2 11/2004 Huang et al.
6,825,970 B2 11/2004 Goenaga et al.
6,866,760 B2 3/2005 Paolini Jr. et al.
6,870,657 B1 3/2005 Fitzmaurice et al.
6,900,851 B2 5/2005 Morrison et al.
6,922,276 B2 7/2005 Zhang et al.
6,950,220 B2 9/2005 Abramson et al.
6,982,178 B2 1/2006 LeCain et al.
6,995,550 B2 2/2006 Jacobson et al.
7,002,728 B2 2/2006 Pullen et al.
7,012,600 B2 3/2006 Zehner et al.
7,023,420 B2 4/2006 Comiskey et al.
7,034,783 B2 4/2006 Gates et al.
7,075,502 B1 7/2006 Drzaic et al.
7,116,318 B2 10/2006 Amundson et al.
7,116,466 B2 10/2006 Whitesides et al.
7,119,772 B2 10/2006 Amundson et al.
7,167,190 B2 1/2007 Ito et al.
7,170,670 B2 1/2007 Webber
7,176,880 B2 2/2007 Amundson et al.
7,193,625 B2 3/2007 Danner et al.
7,202,847 B2 4/2007 Gates
7,236,291 B2 6/2007 Kaga et al.
7,259,744 B2 8/2007 Arango et al.
7,304,787 B2 12/2007 Whitesides et al.
7,312,784 B2 12/2007 Baucom et al.
7,312,794 B2 12/2007 Zehner et al.
7,321,459 B2 1/2008 Masuda et al.
7,327,511 B2 2/2008 Whitesides et al.
7,339,715 B2 3/2008 Webber et al.
7,411,719 B2 8/2008 Paolini, Jr. et al.
7,420,549 B2 9/2008 Jacobson et al.
7,453,445 B2 11/2008 Amundson
7,492,339 B2 2/2009 Amundson
7,513,813 B2 4/2009 Paolini, Jr. et al.
7,528,822 B2 5/2009 Amundson et al.
7,535,624 B2 5/2009 Amundson et al.
7,545,358 B2 6/2009 Gates et al.
7,583,251 B2 9/2009 Arango et al.
7,602,374 B2 10/2009 Zehner et al.
7,612,760 B2 11/2009 Kawai
7,679,599 B2 3/2010 Kawai
7,679,814 B2 3/2010 Paolini, Jr. et al.
7,688,297 B2 3/2010 Zehner et al.
7,719,536 B2 5/2010 Dowling et al.
7,729,039 B2 6/2010 LeCain et al.
7,733,311 B2 6/2010 Amundson et al.
7,733,335 B2 6/2010 Zehner et al.
7,787,169 B2 8/2010 Abramson et al.
7,796,115 B2 9/2010 Zhou et al.
7,800,580 B2 9/2010 Johnson et al.
7,839,381 B2 11/2010 Zhou et al.
7,839,564 B2 11/2010 Whitesides et al.
7,936,499 B2 5/2011 Kim et al.
7,956,841 B2 6/2011 Albert et al.
7,995,029 B2 8/2011 Johnson
7,999,787 B2 8/2011 Amundson et al.
8,009,348 B2 8/2011 Zehner et al.
8,035,611 B2 10/2011 Sakamoto
8,059,142 B2 11/2011 Handschy et al.
8,077,141 B2 12/2011 Duthaler et al.
8,077,169 B2 12/2011 Tanaka
8,081,155 B2 12/2011 Kajino
8,102,363 B2 1/2012 Hirayama
8,125,501 B2 2/2012 Amundson et al.
8,130,192 B2 3/2012 Feng
8,139,050 B2 3/2012 Jacobson et al.
8,169,400 B2 5/2012 Shih
8,174,490 B2 5/2012 Whitesides et al.
8,237,733 B2 8/2012 Rhodes
8,289,250 B2 10/2012 Zehner et al.
8,300,006 B2 10/2012 Zhou et al.
8,305,341 B2 11/2012 Arango et al.
8,310,440 B2 * 11/2012 Miyasaka ..... G09G 3/344 345/107
8,314,784 B2 11/2012 Ohkami et al.
8,319,759 B2 11/2012 Jacobson et al.
8,355,018 B2 1/2013 Rhodes et al.
8,384,658 B2 2/2013 Albert et al.
8,487,919 B2 7/2013 Kobayashi
8,558,783 B2 10/2013 Wilcox et al.
8,558,785 B2 10/2013 Zehner et al.
8,593,396 B2 11/2013 Amundson et al.
8,878,770 B2 11/2014 Miyazaki et al.
8,928,562 B2 1/2015 Gates et al.
9,058,778 B2 6/2015 Rhodes
9,082,351 B2 7/2015 Miyazaki
9,177,511 B2 11/2015 Sato et al.
9,349,327 B2 5/2016 Lee et al.
2003/0102858 A1 6/2003 Jacobson et al.
2004/0227774 A1 11/2004 Matsumoto
2005/0179642 A1 * 8/2005 Wilcox ..... G02F 1/167 345/107
2005/0253777 A1 11/2005 Zehner et al.
2005/0280626 A1 12/2005 Amundson et al.
2006/0132426 A1 6/2006 Johnson
2006/0164405 A1 7/2006 Zhou
2006/0291032 A1 12/2006 Zhou et al.
2007/0035510 A1 2/2007 Zhou et al.
2007/0052667 A1 3/2007 Zhou et al.
2007/0091418 A1 4/2007 Danner et al.
2007/0103427 A1 5/2007 Zhou et al.
2007/0126693 A1 6/2007 Johnson et al.
2008/0024429 A1 1/2008 Zehner
2008/0024482 A1 1/2008 Gates et al.
2008/0094315 A1 4/2008 Johnson
2008/0136774 A1 6/2008 Harris et al.

(56) References Cited

U.S. PATENT DOCUMENTS

| | | | | |
|---|---|---|---|---|
| 2008/0198173 | A1* | 8/2008 | Coates | G09G 3/18 345/596 |
| 2008/0231592 | A1 | 9/2008 | Johnson et al. | |
| 2008/0291129 | A1 | 11/2008 | Harris et al. | |
| 2008/0303780 | A1 | 12/2008 | Sprague et al. | |
| 2008/0309612 | A1 | 12/2008 | Gormish et al. | |
| 2009/0174651 | A1 | 7/2009 | Jacobson et al. | |
| 2009/0179923 | A1 | 7/2009 | Amundson et al. | |
| 2009/0195568 | A1 | 8/2009 | Sjodin | |
| 2009/0237392 | A1* | 9/2009 | Kajino | G09G 3/344 345/214 |
| 2009/0322721 | A1 | 12/2009 | Zehner et al. | |
| 2010/0220121 | A1 | 9/2010 | Zehner et al. | |
| 2010/0265561 | A1 | 10/2010 | Gates et al. | |
| 2010/0277456 | A1 | 11/2010 | Yamada et al. | |
| 2011/0084979 | A1 | 4/2011 | Rutman et al. | |
| 2011/0249041 | A1* | 10/2011 | Otsuki | G09G 3/344 345/690 |
| 2011/0285754 | A1 | 11/2011 | Harrington et al. | |
| 2012/0056867 | A1 | 3/2012 | Van Lier et al. | |
| 2012/0062615 | A1 | 3/2012 | Van Lier et al. | |
| 2012/0098873 | A1* | 4/2012 | Kanamori | G09G 3/344 345/690 |
| 2012/0223973 | A1* | 9/2012 | Uehara | G09G 3/3413 345/690 |
| 2012/0262499 | A1* | 10/2012 | Komatsu | G09G 3/344 345/690 |
| 2012/0268444 | A1 | 10/2012 | Takahashi | |
| 2013/0194250 | A1 | 8/2013 | Amundson et al. | |
| 2014/0292830 | A1 | 10/2014 | Harrington et al. | |
| 2016/0133196 | A1 | 5/2016 | Emelie et al. | |
| 2016/0225322 | A1 | 8/2016 | Sim et al. | |
| 2016/0314733 | A1 | 10/2016 | Crounse | |

FOREIGN PATENT DOCUMENTS

| | | | |
|---|---|---|---|
| JP | 2009204814 | A | 9/2009 |
| JP | 2009271144 | A | 11/2009 |
| JP | 2010113281 | A | 5/2010 |
| JP | 2011221466 | A | 11/2011 |
| JP | 2011242584 | A | 12/2011 |
| WO | 2005006290 | | 1/2005 |
| WO | 2005093705 | A1 | 10/2005 |
| WO | 2007135594 | | 11/2007 |
| WO | 2010147041 | A1 | 12/2010 |

OTHER PUBLICATIONS

Bach, U., et al., "Nanomaterials-Based Electrochromics for Paper-Quality Displays", Adv. Mater, 14(11), 845 (2002) Jun. 5, 2002.

Hayes, R.A., et al., "Video-Speed Electronic Paper Based on Electrowetting", Nature, vol. 425, Sep. 25, pp. 383-385 (2003) Sep. 25, 2003.

Kitamura, T., et al., "Electrical toner movement for electronic paper-like display", Asia Display/IDW '01, p. 1517, Paper HCS1-1 (2001) Jan. 1, 2001.

Yamaguchi, Y., et al., "Toner display using insulative particles charged triboelectrically", Asia Display/IDW '01, p. 1729, Paper AMD4-4 (2001) Jan. 1, 2001.

Korean Intellectual Property Office; PCT/US2013/024106; International Search Report and Written Opinion; dated May 16, 2013. May 16, 2013.

European Patent Office; EP13743527.7; Extended European Search Report; dated Nov. 23, 2015. Nov. 23, 2015.

Korean Intellectual Property Office; PCT/US2017/016925; International Search Report and Written Opinion; dated Apr. 25, 2017. Apr. 25, 2017.

European Patent Office, EP Appl. No. 17750663.1, Extended European Search Report, dated Nov. 15, 2019. Nov. 15, 2019.

* cited by examiner

| x(n+1)= | Next State Neighbors | | | |
|---|---|---|---|---|
| Current State Neighbors | W\|W | W\|B | B\|W | B\|B |
| W\|W | 0 | αK | αK | 0 |
| W\|B | 0 | x(n) | β·x(n)+αKW | 0 |
| B\|W | 0 | β·x(n)+αKW | x(n) | 0 |
| B\|B | 0 | αW | αW | 0 |

FIG. 16

METHODS AND APPARATUS FOR OPERATING AN ELECTRO-OPTIC DISPLAY IN WHITE MODE

REFERENCE TO RELATED APPLICATIONS

This application claims benefit of provisional Application Ser. No. 62/292,829 filed Feb. 8, 2016.

This application is related to U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,729,039; 7,733,311; 7,733,335; 7,787,169; 7,952,557; 7,956,841; 7,999,787; 8,077,141; and 8,558,783; U.S. Patent Applications Publication Nos. 2003/0102858; 2005/0122284; 2005/0253777; 2006/0139308; 2007/0013683; 2007/0091418; 2007/0103427; 2007/0200874; 2008/0024429; 2008/0024482; 2008/0048969; 2008/0129667; 2008/0136774; 2008/0150888; 2008/0291129; 2009/0174651; 2009/0179923; 2009/0195568; 2009/0256799; 2009/0322721; 2010/0045592; 2010/0220121; 2010/0220122; 2010/0265561; 2011/0285754; 2013/0194250 and 2014/0292830; PCT Published Application No. WO 2015/017624; and U.S. patent application Ser. No. 15/015,822 filed Feb. 4, 2016.

The aforementioned patents and applications may hereinafter for convenience collectively be referred to as the "MEDEOD" (MEthods for Driving Electro-Optic Displays) applications. The entire contents of these patents and copending applications, and of all other U.S. patents and published and copending applications mentioned below, are herein incorporated by reference.

BACKGROUND

Field

The present application relates to electro-optic displays and related apparatus and methods.

Related Art

An electro-optic display can be operated by applying voltage signals to one or more pixels of the electro-optic display.

SUMMARY

According to an aspect of the application, a method of operating an electro-optic display is provided. The method comprises detecting a null state transition of a first pixel when transitioning from a first image to a second image. The method further comprises determining whether a threshold number of cardinal neighbors of the first pixel transition from a black state to a white state when transitioning from the first image to the second image, and, in response to a subsequent transition to a third image, applying a voltage signal to the first pixel, wherein the voltage signal has a waveform configured to generate an optical black state for the first pixel.

According to an aspect of the present application, a display is provided. The display comprises an electro-optic display and drive circuitry coupled to the electro-optic display and configured to perform a method. The method comprises detecting a null state transition of a first pixel when transitioning from a first image to a second image. The method further comprises determining whether a threshold number of cardinal neighbors of the first pixel transition from a black state to a white state when transitioning from the first image to the second image, and, in response to a subsequent transition to a third image, applying a voltage signal to the first pixel, wherein the voltage signal has a waveform configured to generate an optical black state for the first pixel.

BRIEF DESCRIPTION OF DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

FIG. 16 is a table illustrating a set of parameters to be used for estimating pixel blooming in accordance with the subject matter presented herein.

DETAILED DESCRIPTION

Figure 1:
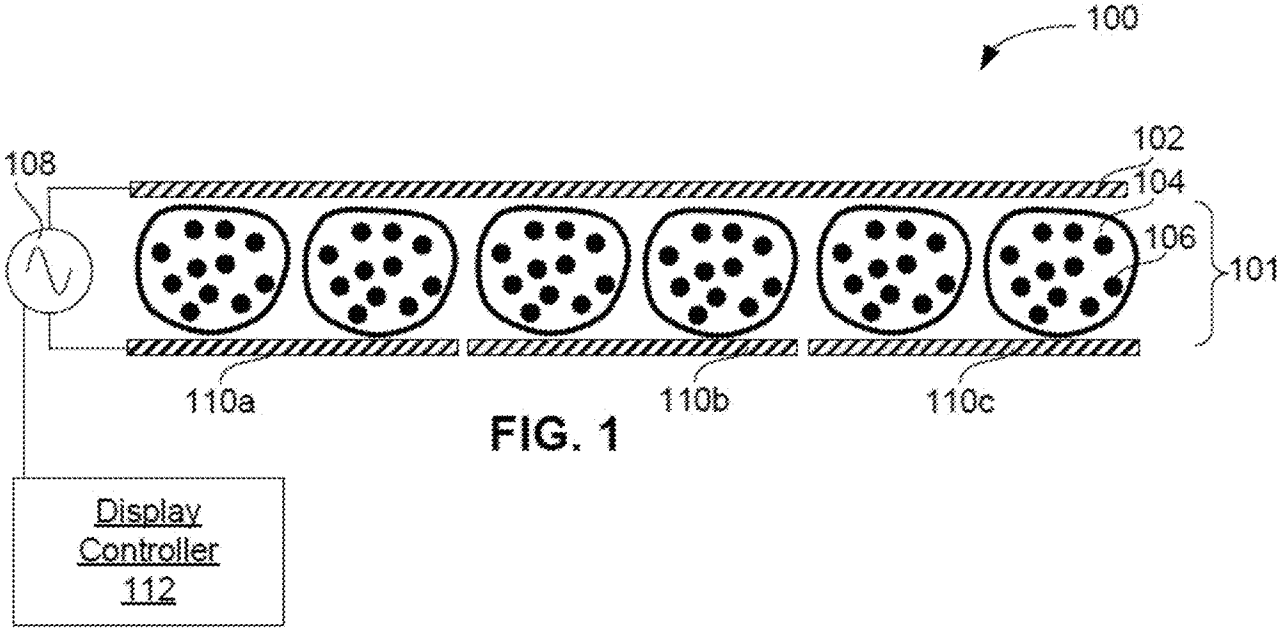
FIG. 1 is a schematic drawing of a cross-sectional diagram of an example of an electro-optic display.

Aspects of the present application relate to utilizing drive signals to reduce the presence of edge artifacts in images displayed on an electro-optic display. One type of edge artifact is the appearance of light edges in dark regions, such as in the body of text characters displayed in white mode where the text is in a black state and the background is in a white state. This type of artifact can arise when a display is driven using techniques to reduce the flashiness of the display by not applying voltage signals (or zero voltage) to pixels that remain in the same state from one image to a subsequent image, which may be considered as a "null state transition."

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to above describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

Much of the discussion below will focus on methods for driving one or more pixels of an electro-optic display through a transition from an initial gray level (or "graytone") to a final gray level (which may or may not be different from the initial gray level). The terms "gray state," "gray level" and "graytone" are used interchangeably herein and include the extreme optical states as well as the intermediate gray states. The number of possible gray levels in current systems is typically 2-16 due to limitations such as discreteness of driving pulses imposed by the frame rate of the display drivers and temperature sensitivity. For example, in a black and white display having 16 gray levels, usually, gray level 1 is black and gray level 16 is white; however, the black and white gray level designations may be reversed. Herein, graytone 1 will be used to designate black. Graytone 2 will be a lighter shade of black as the graytones progress towards graytone 16 (i.e., white).

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

The term "remnant voltage" is used herein to refer to a persistent or decaying electric field that may remain in an electro-optic display after an addressing pulse (a voltage pulse used to change the optical state of the electro-optic medium) is terminated. Such remnant voltages can lead to undesirable effects on the images displayed on electro-optic displays, including, without limitation, so-called "ghosting" phenomena, in which, after the display has been rewritten, traces of the previous image are still visible. The application 2003/0137521 describes how a direct current (DC) imbalanced waveform can result in a remnant voltage being created, this remnant voltage being ascertainable by measuring the open-circuit electrochemical potential of a display pixel.

The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display. A display may make use of more than one drive scheme; for example, the aforementioned U.S. Pat. No. 7,012,600 teaches that a drive scheme may need to be modified depending upon parameters such as the temperature of the display or the time for which it has been in operation during its lifetime, and thus a display may be provided with a plurality of different drive schemes to be used at differing temperature etc. A set of drive schemes used in this manner may be referred to as "a set of related drive schemes." It is also possible, as described in several of the aforementioned MEDEOD applications, to use more than one drive scheme simultaneously in different areas of the same display, and a set of drive schemes used in this manner may be referred to as "a set of simultaneous drive schemes."

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et at, "Video-Speed Electronic Paper Based on Electrowetting", Nature, 425, 383-385 (2003). It is shown in U.S. Pat. No. 7,420,549 that such electro-wetting displays can be made bistable.

One type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in the these patents and applications include:

(a) Electrophoretic particles, fluids and fluid additives; see for example U.S. Pat. Nos. 7,002,728; and 7,679,814;
(b) Capsules, binders and encapsulation processes; see for example U.S. Pat. Nos. 6,922,276; and 7,411,719;
(c) Films and sub-assemblies containing electro-optic materials; see for example U.S. Pat. Nos. 6,982,178; and 7,839,564;
(d) Backplanes, adhesive layers and other auxiliary layers and methods used in displays; see for example U.S. Pat. Nos. 7,116,318; and 7,535,624;
(e) Color formation and color adjustment; see for example U.S. Pat. No. 7,075,502; and U.S. Patent Application Publication No. 2007/0109219;
(f) Methods for driving displays; see the aforementioned MEDEOD applications;
(g) Applications of displays; see for example U.S. Pat. No. 7,312,784; and U.S. Patent Application Publication No. 2006/0279527; and
(h) Non-electrophoretic displays, as described in U.S. Pat. Nos. 6,241,921; 6,950,220; and 7,420,549; and U.S. Patent Application Publication No. 2009/0046082.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, U.S. Pat. Nos. 5,872,552; 6,130,774; 6,144,361; 6,172,798; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode. Electro-optic media operating in shutter mode may be useful in multi-layer structures for full color displays; in such structures, at least one layer adjacent the viewing surface of the display operates in shutter mode to expose or conceal a second layer more distant from the viewing surface.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.) Thus, the resulting display can be flexible. Further, because the display medium can be printed (using a variety of methods), the display itself can be made inexpensively.

Other types of electro-optic media may also be used in the displays of the present invention.

The bistable or multi-stable behavior of particle-based electrophoretic displays, and other electro-optic displays displaying similar behavior (such displays may hereinafter for convenience be referred to as "impulse driven displays"), is in marked contrast to that of conventional liquid crystal ("LC") displays. Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

Whether or not the electro-optic medium used is bistable, to obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a voltage such as to ensure that all the transistors in the selected row are conductive, while there is applied to all other rows a voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed so that the next line of the display is written. This process is repeated so that the entire display is written in a row-by-row manner.

Voltage signals applied to neighboring pixels can impact the optical state of the null state pixels, forming artifacts that can be carried to subsequent images. For example, a voltage signal may not be applied to a pixel that remains as part of a text character from one image to a subsequent image because it undergoes a black state to black state transition (B→B). This may reduce flashiness of the display by applying voltage signals only to pixels that change state between subsequent images. Although flashiness may be reduced, light edge artifacts can arise by such a drive scheme. For a pixel experiencing a null state transition, voltage signals applied to neighboring pixels may affect the optical state of the null state pixel, such as by impacting the distribution of electrophoretic medium of the pixel undergoing the null state transition and creating an undesired change in its optical state. A pixel identified to remain in a black state during a transition may have a lighter optical state because of one or more neighboring pixels undergoing a black state to white state transition. These "blooming events" may occur at the edges of Objects displayed in an electro-optic display, such as the edges of text characters, and may be carried over to subsequent image transitions. Pixels having a lighter optical state may become surrounded by pixels displaying a black optical state in a subsequent image transition, forming light edge artifacts in the image that may be more apparent to a viewer of the display than if the light pixels are on the edge of an object. Accordingly, aspects of the present application relate to identifying pixels that are likely to negatively impact the visual aesthetics of the content displayed based on prior transitions of pixel neighboring the pixel of interest, and applying suitable corrective signals when appropriate to reduce or eliminate such negative impact.

Applicant has appreciated that light edge artifacts can be reduced by identifying pixels that undergo null state transitions and applying a waveform configured to generate an optical state in the pixels when the pixel is likely to contribute to a light edge artifact. The waveform may be a voltage signal configured to regenerate an optical black state of a pixel that has, or may, become lighter because of voltage signals applied to neighboring pixels, such as through blooming Regenerating an optical black state of the pixel may reduce the appearance of light edges that can occur when a pixel is transitioning from a non-black state to a black state and a neighboring pixel that has undergone a black state to black state transition. The waveform may include a voltage signal with amplitude and a duration or time suitable for generating a desired optical state. The voltage signal may be applied over multiple display frames to achieve the desired optical state of the pixel. Examples of suitable waveforms, including a transition waveform referred to as an inverted top-off pulse ("iTop pulse"), are described in aforementioned U.S. patent application Ser. No. 15/015,822 filed Feb. 4, 2016, which is incorporated herein by reference in its entirety.

Yet, if applied too frequently, such waveforms may create irreversible damage to the display, impacting the performance of the display and the quality of displayed images. Accordingly, aspects of the present application relate to methods for selectively applying the waveform to pixels in a manner that suitably balances reducing the appearance of light edge artifacts and the frequency at which the waveform is applied. A drive scheme for an electro-optic display may include identifying pixels undergoing a null state transition where the optical state of the pixels is likely to have been affected by the transitions of neighboring pixels. A waveform for regenerating an optical state of a null state pixel may be applied when neighboring pixels have undergone transitions that may impact the optical state of the null state pixel. For a display operating in white mode, the driving scheme may apply a waveform for regenerating an optical black state to a pixel designated to remain in a black state when neighboring pixels undergo transitions that may result in a lighter optical state of the pixel. In some embodiments, the waveform is applied to a pixel when one or more cardinal neighbors of the pixel undergo a white state to a black state transition between subsequent images. In some embodiments, the waveform is applied to a pixel when one or more cardinal neighbors have a subsequent black state.

The aspects and embodiments described above, as well as additional aspects and embodiments, are described further below. These aspects and/or embodiments may be used individually, all together, or in any combination of two or more, as the application is not limited in this respect.

A cross-sectional view of exemplary electrophoretic display architecture is shown in FIG. 1. Display 100 includes art electrophoretic medium layer 101 which may comprise a plurality of capsules 104 each having a capsule wall surrounding fluid and electrophoretic particles 106 suspended in the fluid. The electrophoretic medium layer 101 is between electrode 102 and pixelated electrodes 110*a*, 110*b*, 110*c*, which define pixels of display 100. The electrophoretic particles 106 may be electrically charged and responsive to an electric field created by electrode 102 and one of electrodes 110*a*, 110*b*, 110*c*. Examples of suitable electrophoretic medium layers are described in U.S. Pat. Nos. 6,982,178 and 7,513,813, which are incorporated herein by reference in their entireties.

The display 100 also includes a voltage source 108 coupled to the electrodes and configured to provide a drive signal to those electrodes. Although FIG. 1 shows coupling of the voltage source 108 between electrodes 102 and 110*a*, voltage source 108 may couple with electrodes 110*b* and 110*c* to provide drive signals to multiple pixels of display 100. The provided voltage then creates an electric field between the electrode 102 and one or more electrodes 110*a*, 110*b*, 110*c*. Thus, the electric field experienced by the electrophoretic medium layer 101 may be controlled by varying the voltage applied to the electrode 102 and one or more electrodes 110*a*, 110*b*, 110*c*. Varying the voltages applied to the desired pixels may provide control over the pixels of the display. Particles 106 within the electrophoretic medium layer 101 may move within their respective capsules 104 in response to the applied electric field created by the voltage between electrode 102 and electrodes 110*a*, 110*b*, 110*c*. Depending on the voltage applied to an electrode, the grayscale of the optical state of a pixel can be controlled.

Voltage source 108 may couple to display controller 112. Display controller 112 may include drive circuitry configured to perform a method of operating display 100. Display controller 112 may include a memory configured to store the states of one or more the pixels of display 100. Current and/or prior states of the pixels may be stored in the memory of display controller 112 in any suitable manner.

While FIG. 1 illustrates a microcapsule type electrophoretic display, various types of displays may be used according the techniques described in the present application. Generally, electro-optic displays including microcapsule type electrophoretic displays, microcell type electrophoretic displays, and polymer dispersed electrophoretic image displays (PDEPIDs) may utilize aspects of the present application. Moreover, although electrophoretic displays represent a suitable type of display according to aspects of the present application, other types of displays may also utilize one or more aspects of the present application. For example, Gyricon displays, electrochromic displays, and polymer dispersed liquid crystal displays (PDLCD) may also take advantage of aspects of the present application.

Figure 2B:
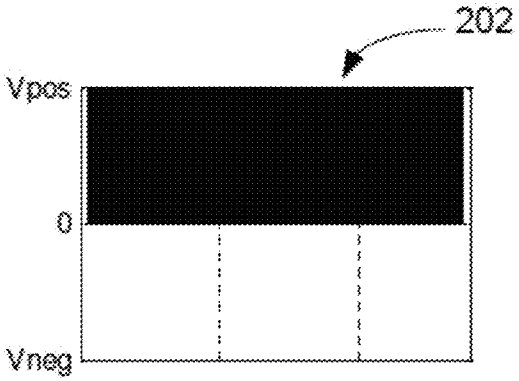
FIG. 2B is an exemplary waveform used to transition a pixel from a white state to a black state.
Figure 2A:
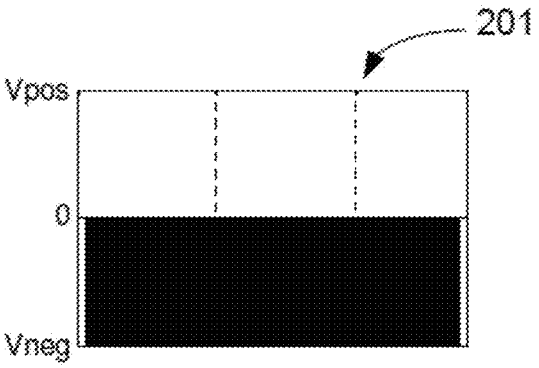
FIG. 2A is an exemplary waveform used to transition a pixel from a black state to a white state.
Figure 4:
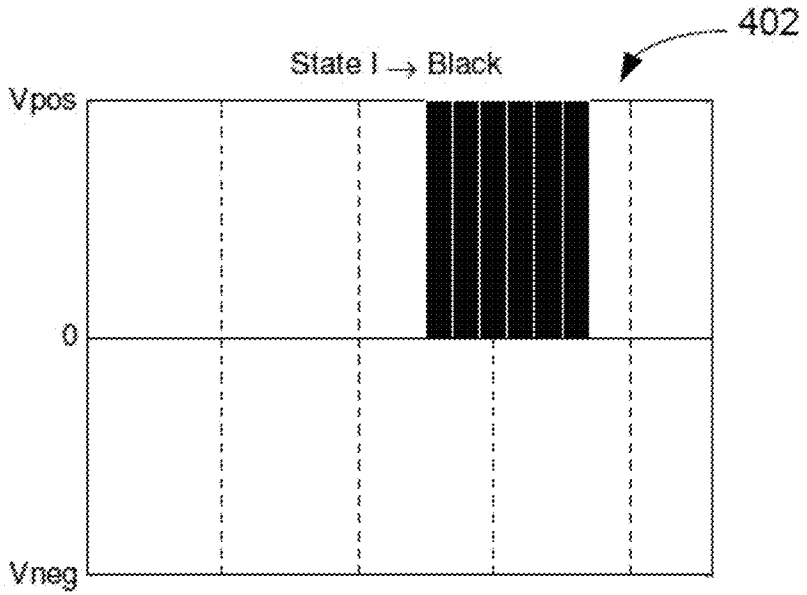
FIG. 4 is an exemplary waveform used to regenerate a black optical state in an exemplary method of operating an electro-optic display.

Pixels of an electrophoretic display, such as display 100 shown in FIG. 1, may be driven to different optical states depending on the voltage signals applied. The voltage signal used to obtain an optical state of a pixel may depend on the previous optical state of the pixel. Depending on the desired state transition for the pixel, the voltage signal may include negative and/or positive voltage. In the examples of FIGS. 2A, 2B, and 4, positive voltages are identified on the y-axis as Vpos and negative voltages as Vneg. In some instances, a waveform having a negative voltage, such as the waveform 201 shown in FIG. 2A, may drive a pixel of an electrophoretic display from a black state to a white state. A waveform having a positive voltage, such as the waveform 202 shown in FIG. 2B, may drive a pixel of an electrophoretic display from a white state to a black state. In FIGS. 2A and 2B, the x-axis represents time and the y-axis represents voltage. Although an electrophoretic display may be driven to another grayscale level, using only two gray levels may simplify the number and complexity of waveforms to use in driving the pixels to transition between different optical states. Using two gray levels may be particularly suited in displays with a higher resolution (e.g., greater than 300 dpi, greater than 500 dpi, between 300 dpi and 800 dpi, or any value or range of values within such ranges) because of the ability to present text to a viewer with a desired level of quality. Techniques for reducing light edge artifacts as described herein may be applied to electrophoretic displays driven at two gray levels (e.g., a white state and a black state) because of the crosstalk between neighboring pixels. For some electrophoretic displays, a voltage signal applied to a pixel may impact a portion of the neighboring pixel, such as approximately one-fifth of the neighboring pixel. Crosstalk between pixels may result in blooming events when a pixel undergoing a null transition has an optical state impacted by a neighboring pixel.

Figures 3A, 3B:
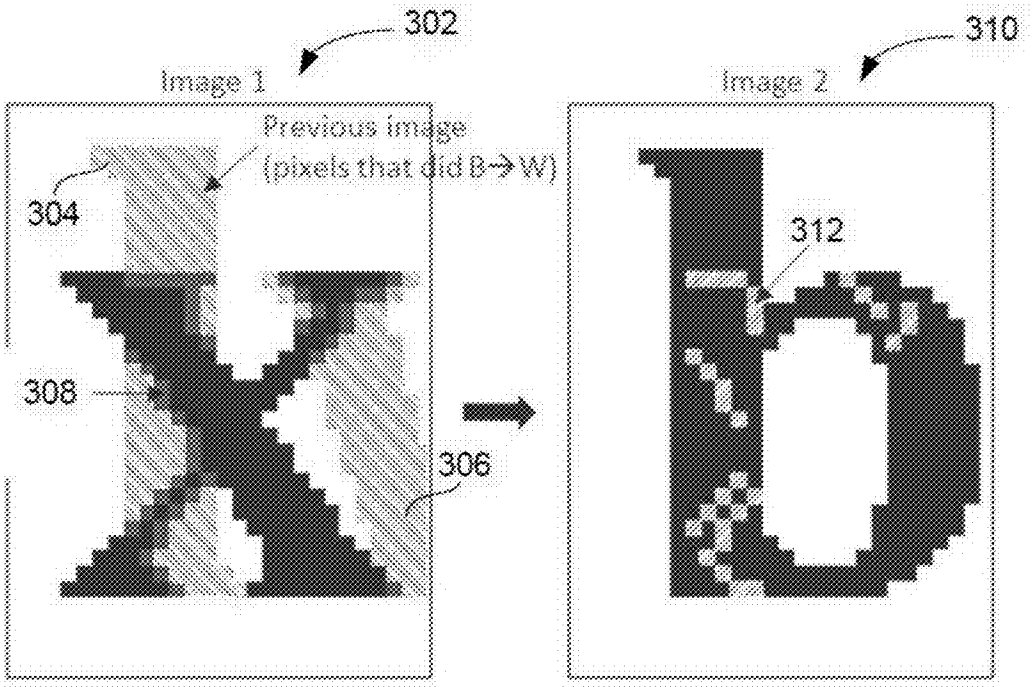
FIGS. 3A and 3B are schematics illustrating the formation of light edge artifacts in images displayed on an electro-optic display.

The appearance of edge artifacts appearing in the text displayed on an electrophoretic display is further discussed with reference to FIGS. 3A and 3B. FIG. 3A depicts a first image 302 (Image 1) that includes the letter "x" representing pixels that are currently in a black state. It is here assumed that a previous image to Image 1 included the letter "l" 304 and a portion of the letter "y" 306, which is shown by the downward diagonal line regions of FIG. 3A. Pixels of the letter "x" that overlap with the letters "l" 304 and "y" 306 of the previous image experienced a black state to black state transition since, in this example, the display is operating with letters as black with a white background. These overlapping pixels may remain in a black state by undergoing a null transition between the previous image and image 1 because a voltage signal is not necessary to change the optical state of these pixels. Pixels of the letters "l" 304 and "y" 306 that do not overlap with the letter "x" underwent a black state to white state transition to create the white background surrounding the letter "x." Although the letters "l" and "y" were displayed in the previous image, they are shown in FIG. 3A to illustrate the overlap between pixels of the letter "x" with the letters "l" 304 and "y" 306 of the previous image.

Applicant has appreciated that a pixel undergoing a null transition (e.g., black state to black state transition) that lacks a voltage signal may experience a blooming event by the presence of voltage signals applied to one or more neighboring pixels. An example is pixel 308. The pixels of the letter "x" that neighbor one or more of the pixels that underwent a black state to white state transition, such as pixel 308, may experience a blooming event and appear lighter than an optical black state. Such pixels are indicated by the dark gray regions within the letter "x." In the resulting image 1 shown in FIG. 3A, the pixels of the letter "x" that appear less dark are positioned at the edge of the text and border a pixel that experienced a black to white transition. Some of the pixels of the letter "x" underwent a white state to black state transition. These pixels are ones that do not overlap with the letters "l" 304 and "y" 306 and may appear darker than the pixels of the letter "x" which neighbor pixels that underwent a black to white transition.

The lighter pixels within the letter "x" resulting from a blooming event may be passed to subsequent images, particularly when the pixel experiences a subsequent null transition. As an example, FIG. 3B illustrates image 310 (Image 2) that includes the letter "b" which has pixels that overlap with the letter "x" of image 1 which underwent a null transition by remaining in a black state. Since some of the pixels of the letter "x" appeared in a lighter optical state due to blooming, this lighter appearance of these pixels is present in the current image of letter "b," an example being pixel 312. These lighter pixels create regions that appear less dark compared to other black pixels. Such light pixels may create the appearance of light "edges" or "lines" within the image and reduce the quality of the image.

Some embodiments of the present application relate to operating an electrophoretic display in a manner that reduces the appearance of light edges within a displayed image, such as those shown in FIG. 3B by pixels 312. Operation of an electrophoretic display may include selectively applying a voltage signal to pixels that may contribute to the presence of light edges, such as to pixels 312. Whether a pixel may contribute to light edge artifacts may be determined by previous transitions of the pixel and one or more pixels that neighbor the pixel in question. In a driving scheme in which voltages are not applied to pixels undergoing null state transitions, such pixels may be the most likely to contribute to the appearance of light edge artifacts. Such a pixel may experience a blooming event when voltage signals applied to one or more neighboring pixels alter the optical state of the pixel in question. The number of neighboring pixels may impact the degree of a blooming event for the pixel, affecting the optical state of the pixel. For example, a pixel may have up to four cardinal neighboring pixels. A moderate blooming event may occur when one cardinal neighbor undergoes a black to white transition. A strong blooming event may occur when all four cardinal neighboring pixels undergo a black to white transition. A pixel experiencing the strong blooming event may appear lighter than the moderate blooming event.

The effect of the blooming event can be reduced by applying a voltage signal to the pixel in question to generate an optical state of the pixel (e.g., a black optical state). While applying the voltage signal may reduce the appearance of bloomed pixels, applying the voltage signal too frequently may damage the electrophoretic display. The voltage signal may be a DC-imbalanced waveform and may result in the buildup of remnant voltage in the display over time as the waveform is applied. Some embodiments of the present application relate to detecting whether a pixel experiences a null transition, determining whether a threshold number of cardinal neighbors of the pixel transition from a black state to a white state during an image transition, and applying a voltage signal to the pixel in a subsequent image transition. The voltage signal may have a waveform configured to generate an optical black state of the pixel.

The type of transition to apply to a pixel may be determined by one or more previous waveform states of the pixel and/or other pixels of the display. A current state of a pixel may determine the type of waveform to apply to the pixel to change or alter the optical state of the pixel. A waveform state may correspond to a desired optical state of the pixel. Prior and/or current states of the pixels in the display may be stored in a display controller, or other suitable circuitry configured to perform a method of operating the display, and allow for determining an appropriate subsequent transition based on a prior or current state of a pixel.

Techniques of the present application relate to associating an indication state (or I state) to a pixel likely to have experienced a blooming event, and which therefore may be prone to appearing as a light pixel in subsequent images if no refresh, or corrective, signal is applied. A pixel may assume, or be assigned, an indication state when the pixel undergoes a black state to black state transition and one or more neighboring pixels undergoes a black state to white state transition. These conditions may identify pixels that have experienced a blooming event. Application of a voltage signal suitable to generate an optical black state in the identified "indication state" pixel may be applied in a subsequent transition to reduce the presence of light edge artifacts. In this manner, the indication state may refer to a pixel that should have a black optical state, but may not appear completely dark because of blooming events from neighboring pixels. Referring to FIG. 3A, pixel 308 may be set to an indication state because it remained in a black state and had one or more neighboring pixels that underwent a black to white transition. Such pixels in FIG. 3A contributed to the light edges that appeared in the letter "b" in FIG. 3B, such as pixel 312.

A voltage signal may be applied to a pixel in an indication state (I state) to generate an optical black state for the pixel and may be referred to as a "black regeneration waveform," according to some embodiments. The voltage signal may have a positive voltage value (e.g., Vpos) over a duration of time, the voltage assuming any suitable value. An exemplary voltage signal used to generate an optical black state is shown in FIG. 4 as waveform 402. The voltage signal may be applied over multiple display frames to achieve the desired result. The waveform may be referred to as an inverted top-off pulse (iTop pulse).

Figure 5:
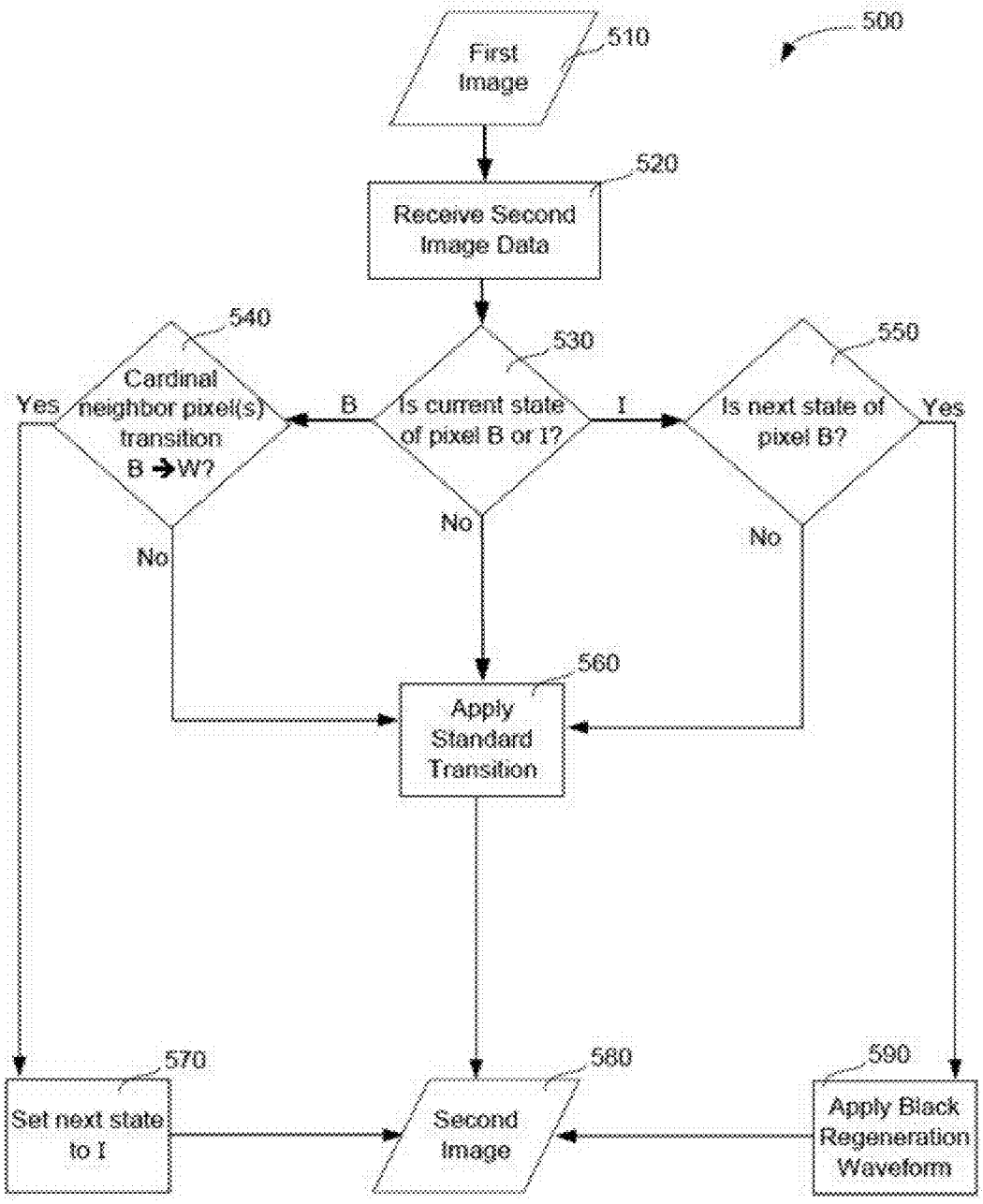
FIG. 5 is a flowchart illustrating an exemplary method of operating an electro-optic display, according to some embodiments of the present invention.

A method of operating an electro-optic display may include detecting a null state transition for one or more pixels and determining whether a threshold number of cardinal neighbors underwent a black state to white state transition between a first image and a second image. It should be noted that "first" and "second" in this context is not limited to an absolute value, but rather are meant to indicate a preceding image and subsequent image. Likewise, a "third" image is not an absolute value but indicates an image subsequent to a "second" image and there may be intervening images between a "second" image and a "third" image. The voltage signal or iTop pulse may be applied to a pixel in an indication state when a subsequent state is a black state. FIG. 5 shows steps of an exemplary method of operating an electro-optic display, according to some embodiments of the present invention. Method 500 may start with first image 510, such as the image prior to Image 1 in FIG. 3A showing the "l" 304 and "y" 306. First image 510 may have a set of states for the pixels of the display, which may be stored in a display controller, such as display controller 112 in FIG. 1. At act 520, second image data is received, such as by display controller 112. The second image data may include optical states of the pixels in the display in order to display the second image, such as Image 1 in FIG. 3A displaying the letter "x," For a given pixel, method 500 proceeds to act 530. If the current state of the pixel is in neither a black (B) state nor an indication (I) state, then a standard transition used to operate the electrophoretic display is applied by act 560 in displaying the second image by act 580.

If the current state of the pixel act 530 is black (B), then method 500 proceeds to act 540, which examines the transitions of the pixel's cardinal neighbors to determine whether one or more of the cardinal neighbors is undergoing a black (B) state to white (W) state transition from the first image to the second image. In some embodiments, act 540 may include determining whether a threshold number (e.g., 1, 2, 3, 4) of cardinal neighbors of the pixel transition from a black state to a white state. If there are no cardinal neighbors experiencing a black state to white state transition or if the number of cardinal neighbors experiencing a black state to white state transition is below a threshold, then the standard transition used to operate the electrophoretic display is applied by act 560 in displaying the second image by act 580. If, by contrast, there is one or more cardinal neighbors experiencing a black state to white state transition or if the number of cardinal neighbors experiencing a black state to white state transition is above a threshold, then the state of the pixel is set to an indication (I) state by act 570 to form the second image by act 580. In this manner, the pixel is identified as potentially experiencing a blooming event by one or more of its cardinal neighbors.

If the current state of the pixel at act 530 is in the indication (I) state, then method 500 proceeds to act 550, which determines the next state of the pixel from the data of the second image. If the next state of the pixel is not the black state (e.g., white state), then the standard transition used to operate the electrophoretic display is applied by act 560 in displaying the second image by act 580. If the next state of the pixel is the black (B) state, then a black regeneration waveform, such as the one depicted in FIG. 4, is applied to the pixel by act 590 in displaying the second image by act 580. In this manner, the black regeneration waveform is applied to those pixels identified as likely to have experienced a blooming event as indicated by being in the indication (I) state. Acts 550 and 590 may occur, for example, for pixel 308 when going from Image 1 of FIG. 3A to Image 2 of FIG. 3B.

Figure 6:
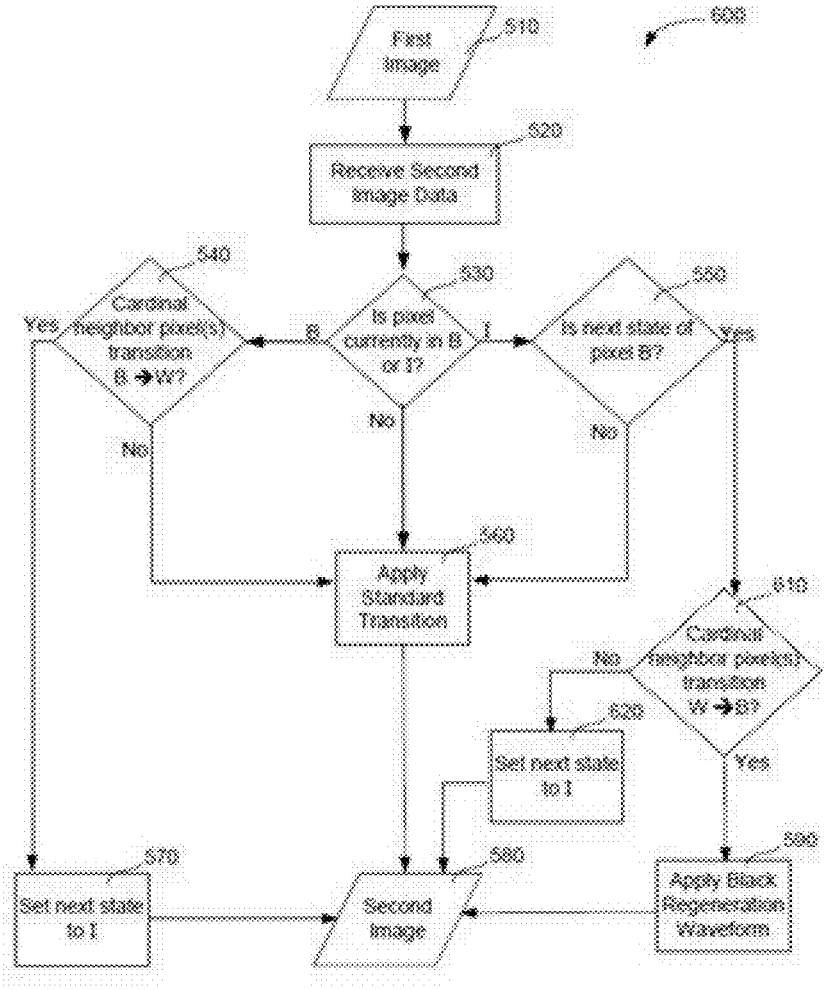
FIG. 6 is a flowchart illustrating an exemplary method of operating an electro-optic display, according to some embodiments of the present invention.

Additional steps to such a method of operating an electro-optic display may provide selectivity in when the black state regeneration waveform is applied. FIG. 6 shows steps of method 600 according to another embodiment, which includes additional steps to those of method 500 shown in FIG. 5. These additional steps provide further selection over when the black regeneration waveform is applied in act 590. A pixel that has a current state as an indication (I) state by act 530 and a next state as the black (B) state by act 550 proceeds to step 610 of method 600, which examines the type of transition for one or more cardinal neighbors of the pixel in transitioning to the second image. If one or more cardinal neighbors transition from a white (W) state to a black (B) state, then the black regeneration waveform is applied to the pixel by act 590 in displaying the second image by act 580. In some embodiments, if the number cardinal neighbors transition from a white (W) state to a black (B) state is above a threshold, then the black regeneration waveform is applied to the pixel. If the pixel does not meet the conditions of act 610 where there are no cardinal neighbors transitioning from a white (W) state to a black (B) state or the number of cardinal neighbors undergoing such a transition is below a threshold, then the pixel is set to the indication (I) state by act 620. In this manner, the pixel may receive the black regeneration waveform when one or more cardinal neighbors transition to a black state to reduce the likelihood of a lighter pixel next to a darker pixel and therefore the visibility of light edge artifacts to a viewer of the displayed second image. By selectively applying the black regeneration waveform under such conditions, a balance in the reduction of the presence of light edges and the frequency at which the waveform is applied can be achieved.

Figure 7:
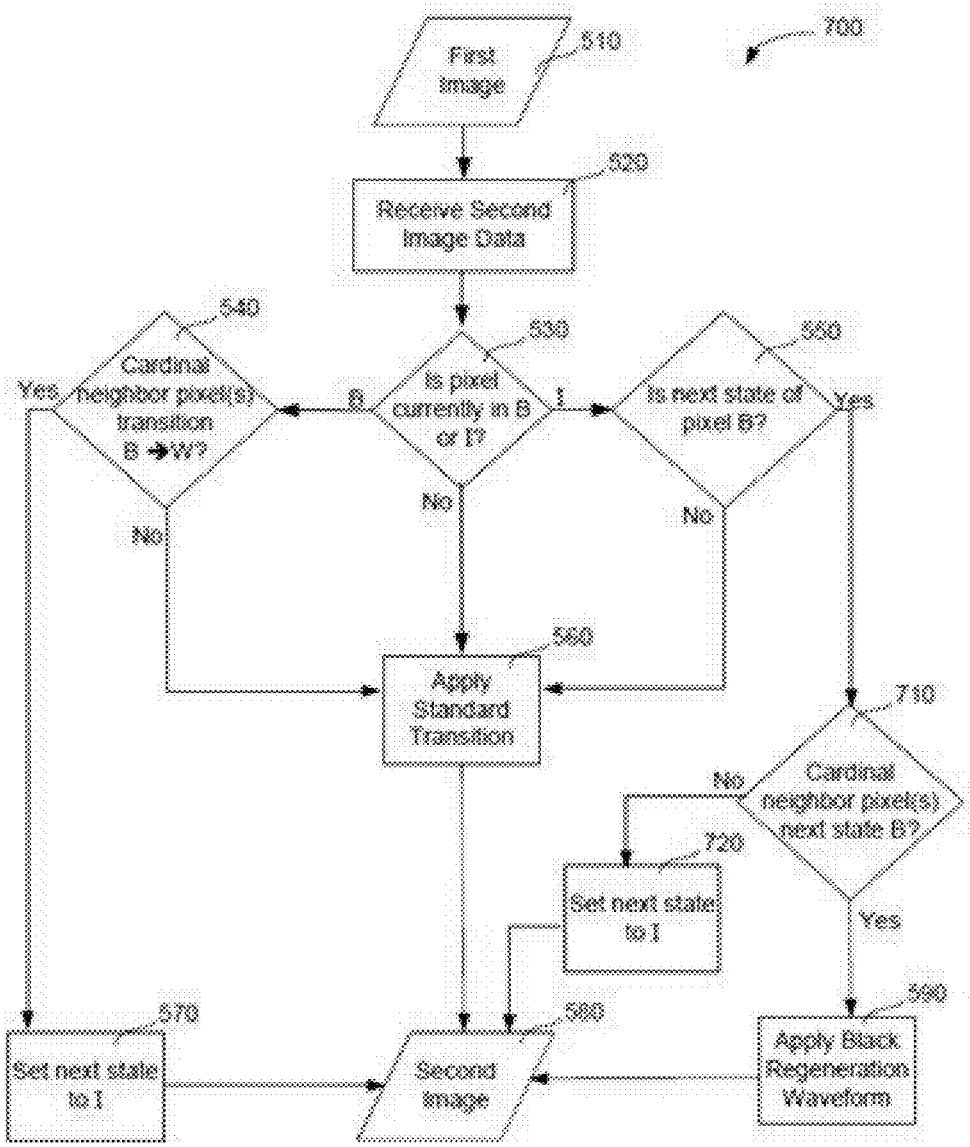
FIG. 7 is a flowchart illustrating an exemplary method of operating an electro-optic display, according to some embodiments of the present invention.

FIG. 7 shows alternative steps that may be implemented in operating an electro-optic display. Method 7 includes additional steps to those of method 500 shown in FIG. 5. These additional steps provide further selection over when the black regeneration waveform is applied in act 590. A pixel that has a current state as an indication (I) state by act 530 and a next state as the black (B) state by act 550 proceeds to step 710 of method 700, which examines the next state for one or more cardinal neighbors of the pixel in the second image. If one or more cardinal neighbors have a next state as a black (B) state, then the black regeneration waveform is applied to the pixel by act 590 in displaying the second image by act 580. In some embodiments, if the number cardinal neighbors transitioning to a black (B) state is above a threshold, then the black regeneration waveform is applied to the pixel by act 590. If the pixel does not meet the conditions of act 710 where there are no cardinal neighbors that have a next state as a black (B) state or the number of cardinal neighbors transitioning to a black state is below a threshold, then the pixel is set to the indication (I) state by act 720. Method 700 provides an alternative method for selectively applying the black regeneration waveform to pixels in reducing the presence of light edge artifacts in images displayed on the electro-optic display.

Figure 8A:
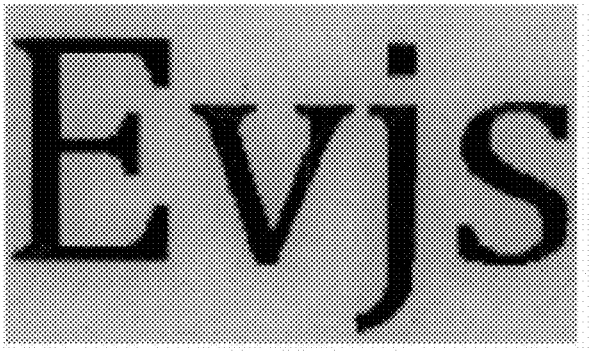
FIG. 8A is an exemplary image of text displayed without correction for light edge artifacts.
Figure 8B:
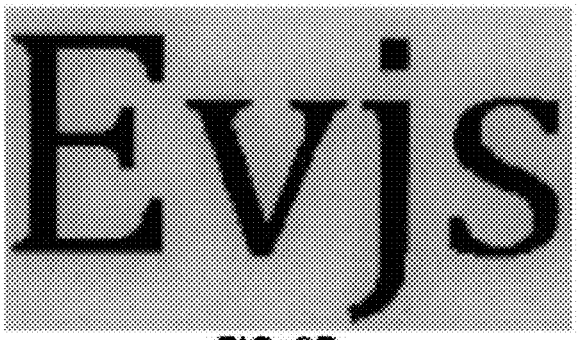
FIG. 8B is an exemplary image of text displayed with correction for light edge artifacts, according to the subject matter presented herein.

The techniques described herein may reduce the presence of light edge artifacts in displaying images, such as text, on an electro-optic display. FIG. 8A shows an example image of text displayed on an electro-optic display where such light edge correction is not used. The appearance of lighter regions in the text, particularly in the letters "v" and "j," is present. FIG. 8B shows an example image of the same text shown on an electro-optic display operated in a manner described herein to reduce the presence of such light edge artifacts.

Figure 9:
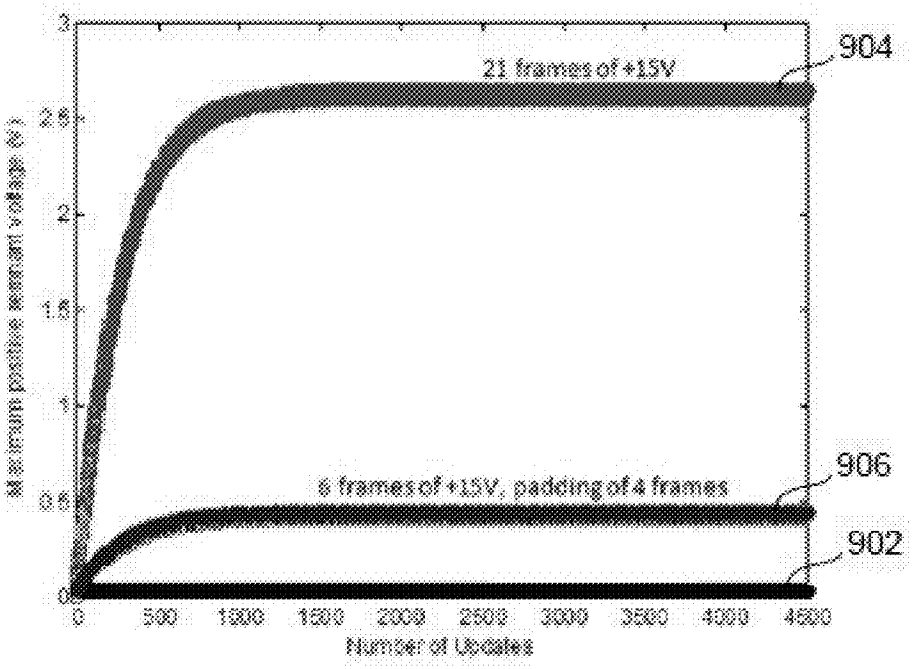
FIG. 9 is a plot of simulated remnant voltage across an electro-optic display.

A voltage signal used to regenerate the black optical state of the pixel may be DC-imbalanced and create irreversible damage to the display arising from the buildup of remnant voltage in the display. Techniques of the present application relate to methods of applying the waveform selectively to reduce the buildup of remnant voltage and damage to the display. FIG. 9 illustrates a plot of simulated remnant voltage across a display for the display usage scenario of displaying 4500 subsequent images (e.g., pages of text) on the display using a light edge correction operation method according to the techniques described herein for different types of black regeneration waveforms with reference to a null state transition waveform 902. If the black regeneration waveform 904 includes 21 frames of a +15V drive signal, then such a waveform could create a remnant voltage at a pixel of the display to exceed 2.5 V, which would likely damage the display. However, if the black regeneration waveform 906 includes 6 frames of a +15 V drive signal with a padding of 4 frames, then such a waveform could create a remnant voltage at a pixel less than 0.5V, which may be considered a suitable amount of remnant voltage to reduce damage to the display.

Differential Blooming

Figure 10B:
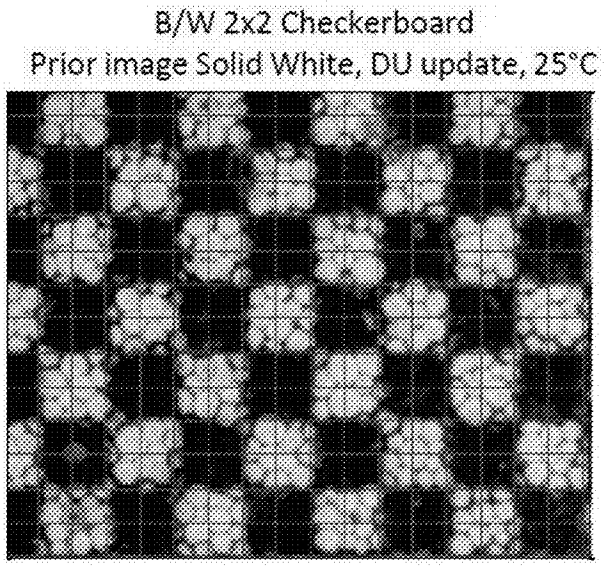
FIG. 10B is an electro-optic display showing another checker board like pattern.
Figure 10A:
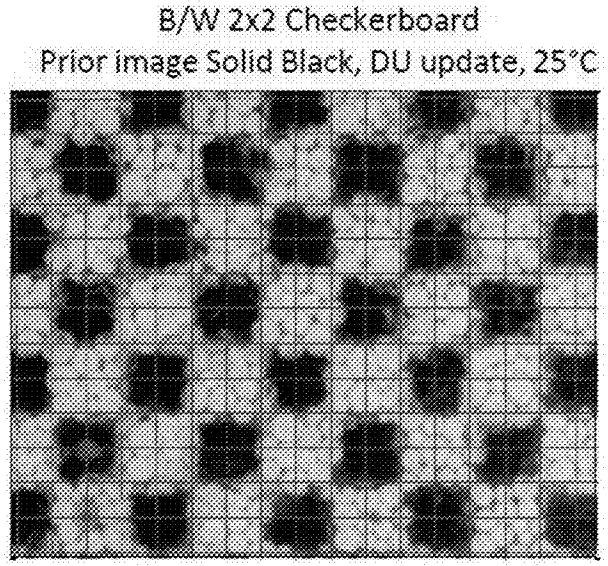
FIG. 10A is an electro-optic display showing a checker board like pattern.

In addition to the blooming effect described above, image quality of an electrophoretic display (EPD) may be further affected by so called differential blooming effect. FIGS. 10A and 10B are two checker board like image patterns for illustrating the differences in blooming (or differential blooming) depending on whether the prior displayed image is solid black or solid white and whether the EPD is updated using a so called direct-update (DU) waveform. The DU waveform updates the EPD in such a fashion that the EPD pixels going through black to white and white to black transitions receive a single pulse of driving where a typical pulse has a duration of about 250 ms. Waveforms presented in FIGS. 2A and 2B may be adopted as DU waveforms in some embodiments. All other pixels (not going through a transition) receives a null (i.e., empty or no update) waveform. As such, the DU waveform is characterized as a 1-bit waveform. Accordingly, as illustrated in FIG. 10A, the pixels going through a black to black transition received a null waveform while their neighboring pixels going through black to white transitions received a DU waveform. Similarly, in FIG. 10B, pixels that remained from white to white received a null waveform while their neighboring pixels going through a white to black transition received DU waveforms.

As can be seen in FIGS. 10A and 10B, crosstalk between pixels can lead to optical artifacts (i.e., blooming) where pixels bloom over and into their neighbors. Differential blooming occurs when blooming characteristics differ depending on the prior image being displayed by the EPD's pixels, as can be appreciated by a comparison of FIGS. 10A and 10B, where the average reflectance of the black and white checker board is much lighter when the prior image is black compared to when the prior image is white.

Figure 11:
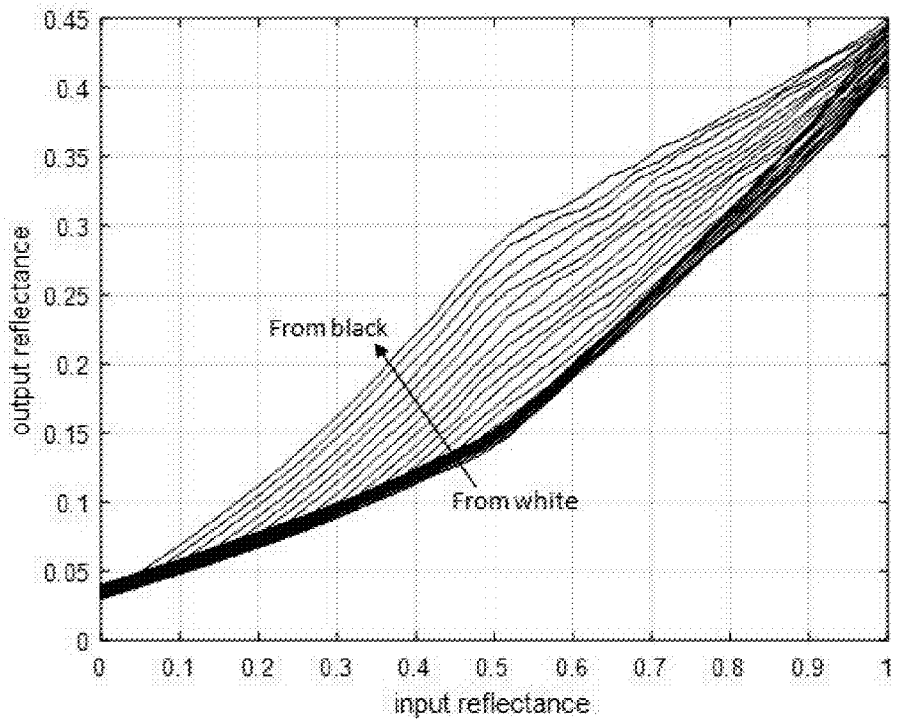
FIG. 11 is a plot of measured output reflectance versus input reflectance.

FIG. 11 is a plot of measured output reflectance versus input reflectance from 32 different prior states linearly spaced in reflectance between pure black and pure white. In this measurement setup, the prior state is a gray-tone that is rendered by 1-bit dithering using dispersed dot ordered dither. For example, the prior state for the mid gray-tone may be a checkerboard with 50% black and 50% white pixels where each square is a single pixel. From this prior state, the EPD is updated with DU to another gray-tone referred to as the input reflectance. This input reflectance corresponds to the desired gray-tone to be displayed. In this setup, the input reflectance ranges from 0 to 1 where 0 is solid black and 1 is solid white. The output reflectance is the measured reflectance on the display from the final image. Such curves are referred to as the tone reproduction curves (TRC). As illustrated in FIG. 11, the TRC varies significantly depending on the prior state mainly due to the differential blooming.

Figure 12C:
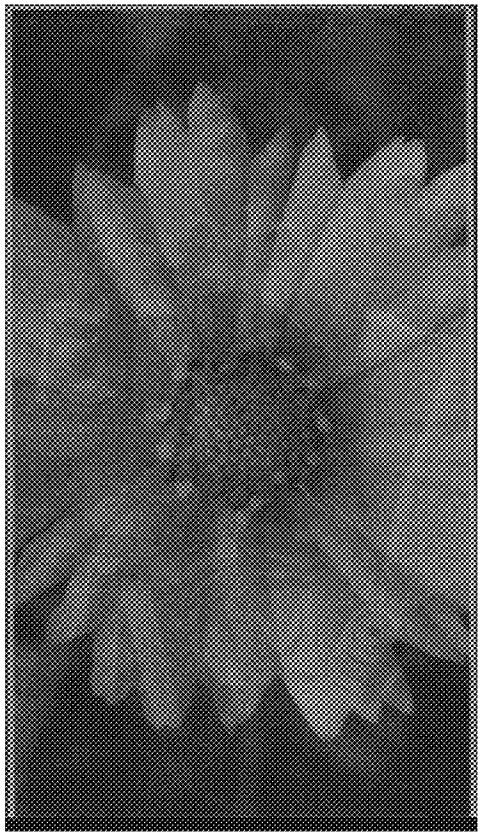
FIG. 12C is a resulting image after an electro-optic display has been updated with the images of FIG. 12A and FIG. 12B.
Figure 12B:
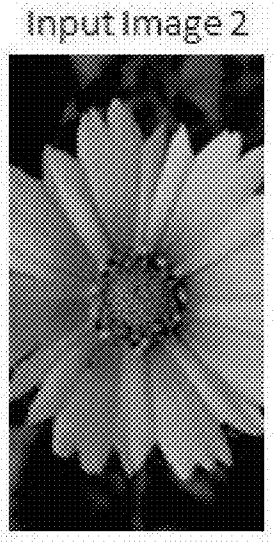
FIG. 12A and FIG. 12B are input images to be displayed on an electro-optic display.
Figure 12A:
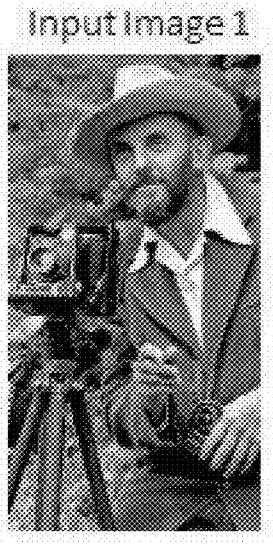

In some cases, the level of differential blooming illustrated in FIG. 11 can lead to significant image ghosting (e.g., up to 10 L* in image quality), as shown in FIG. 12C, where FIG. 12A is the first input image and FIG. 12B is a subsequent image to be displayed on the EPD.

In some embodiments, this ghosting effect may be significantly reduced by setting the EPD pixels to an original or starting optical state, for example, solid white. In this fashion, an EPD may be conveniently updated with DU waveforms where the update time is swift (e.g., 250 ms). In use, the update waveform may be designed such that all the pixels go to white first before going their final states. As a result, the blooming will always be the same for all pixels no matter where they came from, which effectively eliminates differential blooming.

In some embodiments, a drive waveform can be configured such that all the pixels finish their transitions to white before any pixels start transitions to black, and each phase or transitions of the waveforms are aligned temporally (e.g., the transitions of the waveforms start and end at the same time). Specifically, for this setup, all the pixels finish their transition to white before any pixel starts transitioning to black. In practice, it will look like a white page is inserted in the middle of any transition from an image to another image. It also results in a transition appearance that may be described as "clean" or "calming" as opposed to "flashy" for typical GC waveforms. This will enable 1-bit usage in EPDs with reasonable ghosting performance.

Figures 13A, 13B, 13C, 13D:
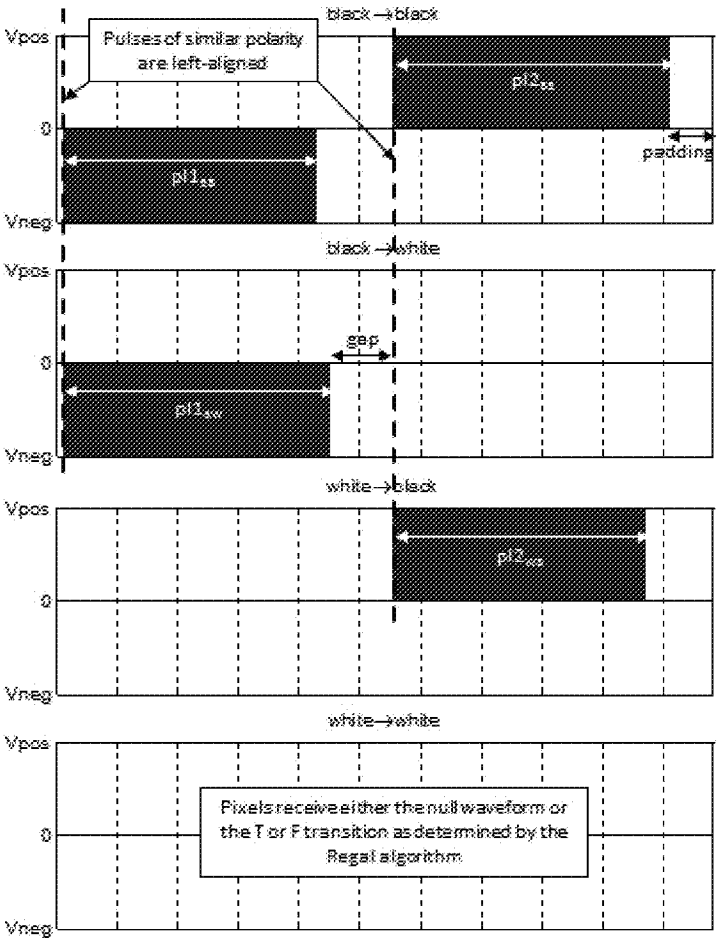
FIG. 13A to FIG. 13D are embodiments of driving waveforms that are in accordance with the disclosures presented herein.

FIGS. 13A to 13D illustrate exemplary 1-bit waveforms for four active transitions: black to white (FIG. 13A), black to black (FIG. 13B), white to black (FIG. 13C), and white to white (FIG. 13D). Overall, the waveforms can include 6 tunable waveform parameters: $pl1_{BB}$, $pl2_{BB}$, $pl1_{BW}$, $pl2_{WB}$, gap and padding. The parameters $pl1_{BB}$ and $pl1_{BW}$ correspond to the pulse lengths for the drives to white for the black to black and black to white transitions; the parameters $pl2_{BB}$ and $pl2_{WB}$ correspond to the pulse lengths for the drives to black for the black to black and white to black transitions. Those 4 parameters may be independently adjusted from 50 ms to 500 ms. The gap parameter corresponds to the gap in time between the end of the last drive to white (for either the black to black or black to white transitions) and the beginning of the first drive to black (for either the black to black or white to black transitions). The gap parameter may vary from 0 to 100 ms in duration. The padding parameter corresponds to the time between the last drive to black and the end of the waveform, and it may also vary from 0 to 100 ms in duration. In addition, the waveform transitions are aligned in order to create a very clean transition appearance. In FIGS. 13A to 13D, the waveform is shown to be left-aligned which means that the drives to white and the drives to black all start at the same time. However, it may also be possible for the waveform to be right-aligned, meaning that the drives to white and the drives to black all end at the same time. The white to white transition is empty to further reduce the waveform flashiness and enable the clean transition appearance. These waveforms may be integrated with the other driving algorithms or schemes (e.g., EInk Regal algorithms) for better performances and avoid edge accumulation with this scheme. In some cases, for example, the white to white pixels may either receive a null waveform or the T or F transitions as determined by the Regal algorithm. The T transition is to be properly placed such that it is positioned within the drives to white.

Figure 14:
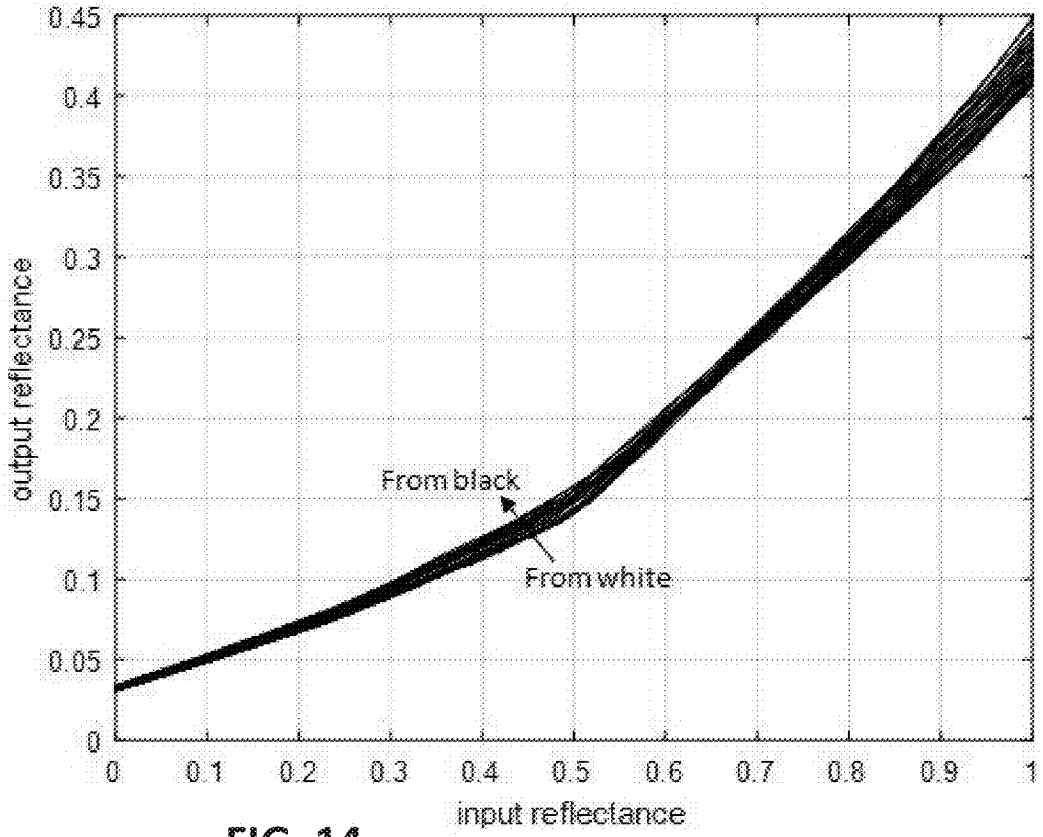
FIG. 14 is a plot of measured output reflectance versus input reflectance using the waveforms presented in FIG. 13A to FIG. 13D.
Figure 15:
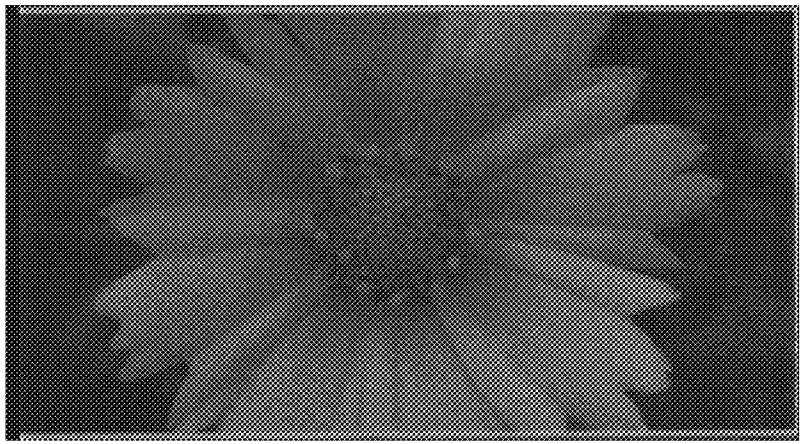
FIG. 15 is a resulting image after an electro-optic display has been updated using the waveforms presented in FIG. 13A to FIG. 13D.

In some embodiments, the parameters described above may be further tuned to meet various design goals, such as minimizing the waveform area ghosting and blooming, as well as optimize display reliabilities. Certain parameter combinations may lead to significant DC-imbalance experienced by the display in usage. It is therefore preferred to control the amount of DC-imbalance introduced by this waveform in order to ensure long-term reliability and avoid display performance degradation over time. This waveform concept results in significant reduction in differential blooming as illustrated in FIG. 14.

In a comparison to the image presented in FIG. 12C, adopting the waveforms discussed in FIGS. 13A to 13D provide for a resulting figure that is ghosting free due to significant reduction in differential blooming. While this waveform configuration results in an update time that is longer than DU waveforms and similar to typical GC waveforms, the waveform alignment results in a very clean and low flash transition appearance that makes the updating transitions appearing to be faster and more direct, especially compared to typical GC waveforms that look very flashy when displaying images.

History Dependent Blooming Model

As discussed above, when two adjacent pixels are undergoing different transitions, some cross-talk can be present and they may affect their neighbor's optical state. When this takes the form of a net extension of one of the final optical states over the other it can be consider a "blooming" artifact. Physically this can take many forms, but in practice it can be summarized as a net increase or decrease of reflectance over the nominal average value expected from the two pixel area. This is most easily expressed as an "effective blooming width" (EBW) for that blooming pair of transitions which is a number with units of length that is positive if the net effect is to lighten and negative if it is to darken. This EBW number can then be used to predict the delta reflectance expected from these pixel pairs in some area by multiplying the EBW by the difference in the two nominal optical states and the edge density (length/area) of that pair.

Presented in FIG. 16 is a table of parameters for a dithering model that can be used to: (1) progressively model the local blooming at each display pixel, and (2) modify error diffusion algorithms which uses the model to dither the image appropriately. In some embodiments, an estimate of the current optical impact of the blooming is kept for each pixel edge in the image. Since there are twice as many edges as pixels, it is convenient to keep two display-sized (in number of pixels) arrays in memory to hold this information. For our purposes we will call them bloomUp and bloomLeft which hold the estimate of the optical effect caused by blooming with the upward neighbor and leftward neighbor of the associated pixel respectively. If the previous state and current state of the display is known, then the next bloomUp and bloomLeft arrays can be updated by examining each pixel pair across the specified edge (Up or Left) and replacing the value with that computed in the table illustrated in FIG. 16.

As shown in FIG. 16, the parameters $\alpha K$ and $\alpha W$ are effective blooming width (EBW) scores (for black and white pixels respectively) derived from system measurements divided by the length of the pixel edge. The parameters $\beta$ and $\alpha KW$ can be derived from a special experiment where pixels in a checkerboard are successively toggled and the resulting optical state is measured. Then this data can be fit to the model to find the parameters. The $\beta$ parameter represents the degree of non-erasing of the previous blooming. In one practical example using a V320 on a 500 dpi panel, we had $\beta=0.54$ which means just over ½ of the previous blooming effect remained after this particular update pair.

It should be appreciated that the parameters shown in FIG. 16 is one exemplary configuration of a model, as these parameters and the exact configuration can be conveniently adjusted to better adopt to a user's specific needs. For example, FIG. 16 shows a new value x(n+1) for a bloomUp or bloomLeft entry based on the current and next state of the associate blooming pixel pair and the current value x(n). This follows from an assumption that if the next state of the pair is the same, there is no blooming, hence the zero entries. However, even when using blooming reducing waveforms (e.g., the Regal algorithm/waveforms), some edge can remain in these cases, and this could be included in the model. More generally, each entry in the table shown in FIG. 16 could have a formula for the model that includes an erasing term and a contribution term.

Figure 17:
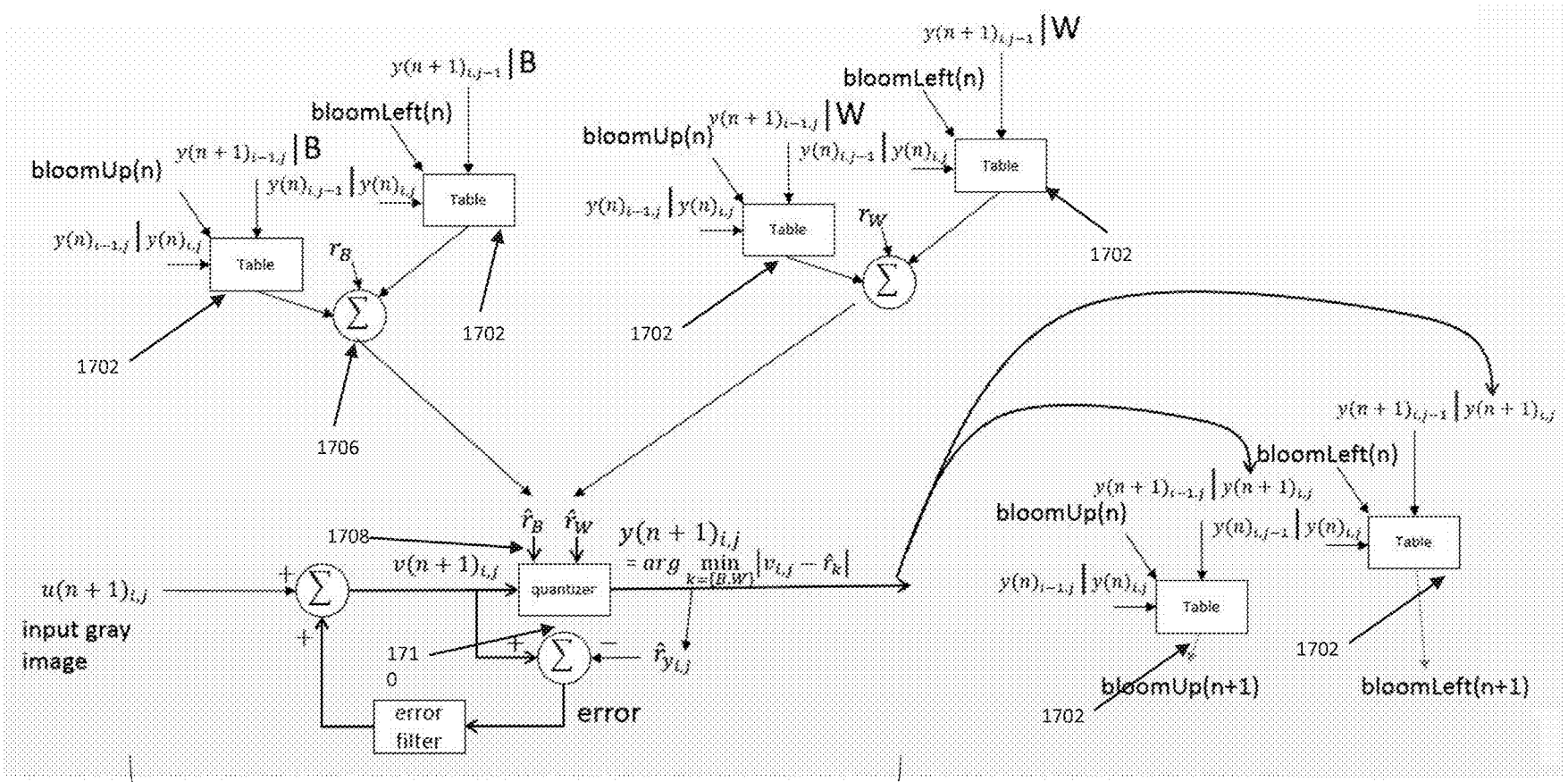
FIG. 17 is a model illustrating one embodiment of a dithering process in accordance with the subject matter disclosed herein.

In use, the parameters presented in FIG. 16 can be incorporated into a dithering process in at least two ways. The first, simplest way is to make quantization decisions as normal in error diffusion. Then once the decision is made, compute the actual optical effect by including the result of the blooming update model for that decision when computing the error to be diffused. Since error diffusion is causal and normally computed row by row, top to bottom, the Upper and Left neighbor's outputs (next state and errors) are already known and so the bloomUp and bloomLeft values can be updated as soon as the decision is made. A second method, which is illustrated in FIG. 17, is to use the blooming model directly in the quantizer. In this case, the bloomLeft and bloomUp values are computed for both viable output options for the pixel under consideration. These are then used to modify the optical states being presented as choices to the quantizer, and so the quantizer will be forward looking and know which choice will introduce the least error.

Specifically, FIG. 17 illustrates a dithering system (e.g., an error diffusion algorithm 1704) in accordance with the subject matter presented herein configured to calculate the gray tones of display pixels. In this configuration, this error diffusion algorithm 1704 may be designed to work in a looping fashion such that computed bloomLeft and bloomUp values can be fed back to the algorithm 1704 to calculate subsequent values. In this fashion, the overall system is self-adjusting and continuously being updated. Initially, starting bloomLeft and bloomUp values may be computed using parameters looked up from tables 1702, where the tables 1702 are similar to the parameter table presented in FIG. 16. In some embodiments, the starting bloomLeft and bloomUp values may be predetermined experimentally and together with an initial expected reflectance value $r_B$ may be fed through a summation algorithm 1706. The summation algorithm 1706 can compute for a offset reflectance value 1708 to be fed into a quantizer 1710 of the algorithm 1704, the quantizer 1710 being configured to compute the bloomLeft and bloomUp values for the next pixel update. In this fashion, the gray tone of the display pixels may be continuously adjusted depending on the blooming effect of each pixels, which depend on previous optical states, as discussed above.

Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. It is, therefore, to be understood that the foregoing embodiments are presented by way of example only and that, within the scope of the appended claims and equivalents thereto, inventive embodiments may be practiced otherwise than as specifically described. In addition, any combination of two or more features, systems, articles, materials, kits, and/or methods described herein, if such features, systems, articles, materials, kits, and/or methods are not mutually inconsistent, is included within the scope of the present disclosure.

Also, as described, some aspects may be embodied as one or more methods. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

In the claims, as well as in the specification above, all transitional phrases such as "comprising," "including," "carrying," "having," "containing," "involving," "holding," "composed of," and the like are to be understood to be open-ended, i.e., to mean including but not limited to. The transitional phrases "consisting of" and "consisting essentially of" shall be closed or semi-closed transitional.

The invention claimed is:

1. A method of operating an electro-optic display which undergoes a first transition from a first image to a second image, and a second transition from the second image to a third image, the method being characterized by:

detecting a null state transition of a first pixel from black in the first image to black in the second image;

determining, using an algorithm and assigning an indication state to the first pixel, when the number of cardinal neighbors of the first pixel transitioning from a black state in the first image to a white state in the second image is at least equal to a threshold number; and during the second transition, applying to the first pixel assigned with the indication state a voltage signal configured to generate an optical black state for the first pixel.

2. The method of claim 1, wherein the voltage signal is applied to the first pixel if the first pixel is black in the third image.

3. The method of claim 1, wherein the voltage signal is applied to the first pixel if the first pixel is black in the third image and the number of cardinal neighbors of the first pixel transitioning from a white state to a black state during the second transition is at least equal to a second threshold number.

4. The method of claim 1, wherein the voltage signal is applied to the first pixel if the first pixel is black in the third image and the number of cardinal neighbors of the first pixel are in a black state in the third image.

5. The method of claim 1 further comprising storing an indication associated with the first pixel if the number of cardinal neighbors of the first pixel transitioning from a black state in the first image to a white state in the second image is at least equal to the threshold number; and applying the voltage signal to the first pixel during the second transition based at least in part on the presence of the indication.

6. A display comprising:

an electro-optic display;

drive circuitry coupled to the electro-optic display and configured to perform a method of operating the electro-optic display which undergoes a first transition from a first image to a second image, and a second transition from the second image to a third image, the method comprising:

detecting a null state transition of a first pixel from black in the first image to black in the second image;

determining, using an algorithm and assigning an indication state to the first pixel, when the number of cardinal neighbors of the first pixel transitioning from a black state in the first image to a white state in the second image is at least equal to a threshold number; and during the second transition, applying to the first pixel assigned with the indication state a voltage signal configured to generate an optical black state for the first pixel.

7. The display of claim 6, wherein the threshold number of cardinal neighbors is one.

8. The display of claim 6, wherein the threshold number of cardinal neighbors is greater than one.

* * * * *